US005099677A

United States Patent [19]

Tokura

[11] Patent Number: 5,099,677

[45] Date of Patent: Mar. 31, 1992

[54] PIPE EXPANDING APPARATUS

[75] Inventor: Kenji Tokura, Osaka, Japan

[73] Assignee: Kyoshin Kogyo Kabushiki Kaisha, Osaka, Japan

[21] Appl. No.: 616,193

[22] Filed: Nov. 20, 1990

[51] Int. Cl.[5] ..... B21D 37/12

[52] U.S. Cl. ..... 72/456; 72/373; 72/453.06; 29/727; 29/890.044

[58] Field of Search ..... 72/75, 370, 373, 455, 72/456, 472, 453.06; 29/727, 890.44

[56] References Cited

U.S. PATENT DOCUMENTS

| | | | |
|---|---|---|---|
| 3,824,668 | 7/1974 | Wightman | 29/727 |
| 4,597,171 | 7/1986 | Kitayama et al. | 29/890.044 |
| 4,766,667 | 8/1988 | Gray | 29/727 |
| 4,980,966 | 1/1991 | Milliman et al. | 29/727 |

FOREIGN PATENT DOCUMENTS

| | | | |
|---|---|---|---|
| 0174234 | 10/1984 | Japan | 29/890.044 |

*Primary Examiner*—David Jones
*Attorney, Agent, or Firm*—Koda and Androlia

[57] ABSTRACT

A pipe expanding apparatus comprising a reciprocating member to which a plurality of pipe expanding mandrels are attached to be capable of being inserted into a plurality of pipes to be expanded under pressure, a plurality of guide posts penetrating through the reciprocating member at desired locations for slidably guiding the reciprocating member, and extending and contacting apparatus which is mounted on a frame uprightly provided on a base, and is operated to reciprocate the reciprocating member for expanding the pipes. The extending and contracting apparatus is constituted by at least one pair of cylinders disposed at both lateral side ends of the reciprocating member, respectively, for inserting the mandrels attached to the reciprocating member into the pipes to be expanded under pressure when actuated.

4 Claims, 3 Drawing Sheets

PIPE EXPANDING APPARATUS

FIELD OF THE INVENTION

The present invention relates to a pipe expanding apparatus, and more particularly to a pipe expanding apparatus suitable to insert mandrels, provided above pipes to be expanded, into the pipes under pressure for thereby expanding the pipes.

BACKGROUND OF THE INVENTION

Heretofore, a pipe expanding apparatus of the above type is arranged as shown in FIG. 5, for example. A frame 9*a* is uprightly provided on a base 9 and a cylinder 10 is mounted at the top of the frame 9*a*, with a plurality of mandrels 12 vertically downwardly extending from a reciprocating member 11. The reciprocating member 11 is vertically movable upon extension and contraction of the cylinder 10, and is installed in place with the aid of plural guide posts 13 for guiding the vertical movement of the reciprocating member 11 in slidable relation. Pipes 14 to be expanded are previously set at positions corresponding to the mandrels 12 attached to the reciprocating member 11. When the reciprocating member 11 is descended, the mandrels 12 are inserted into the corresponding pipes 14 under pressure for thereby expanding the pipes arranged in a desired pattern.

However, the conventional pipe expanding apparatus described above has suffered from the problems as follows.

In the above conventional pipe expanding apparatus, the pipes to be expanded, the mandrels for expanding the pipes, the reciprocating member, and the cylinder for vertically moving the reciprocating member are all provided to line up successively in the longitudinal direction of the pipe expanding apparatus. This makes the entire length of the pipe expanding apparatus very large in the direction of expanding the pipes.

Accordingly, in the case the above pipe expanding apparatus is of the vertical type, for example, the entire height of the apparatus is extremely increased, which makes it very difficult to carry and install the apparatus in buildings such as factories.

Further, the conventional pipe expanding apparatus has the guide posts provided to slidably penetrate through four corners of the reciprocating member for vertically moving the reciprocating member in a smooth manner when the pipes are expanded, without causing any distortion such as a twist. In addition, the cylinder is disposed between the laterally spaced pairs of the guide posts, and has a rod 10*a* which is extended and contracted to respectively descend and ascend the reciprocating member.

With such arrangement, the cylinder for vertically moving the reciprocating member must be given by a single cylinder of large capacity located substantially at the center of the reciprocating member in consideration of the problem of space. Such a large-capacity cylinder has the very high cost per unit. Moreover, the guide posts disposed at both lateral side ends of the reciprocating member are generally employed four in number to penetrate through its four corners, respectively, for smooth vertical movement of the reciprocating member upon extension and contraction of the cylinder located substantially at the center of the reciprocating member. This requires the cost of the four guide posts.

SUMMARY OF THE INVENTION

It is therefore an object of the present invention to solve all the above-described problems in the prior art, and to provide a pipe expanding apparatus which is significantly improved in that the entire length or the entire height of the apparatus can be as small as possible to realize efficient use of space by employing cylinders as one pair of guide posts for slidably guiding a reciprocating member of the pipe expanding apparatus; no distortion such as a twist is caused during vertical movement of the reciprocating member by uniformly applying pressure to the reciprocating member at both lateral side ends thereof; and the apparatus can be produced at the remarkably lowered cost through simplification of the structure.

Specifically, the present invention resides in a pipe expanding apparatus comprising a reciprocating member to which a plurality of pipe expanding mandrels are attached to be capable of being inserted into a plurality of pipes to be expanded under pressure, a plurality of guide posts penetrating through the reciprocating member at desired locations for slidably guiding the reciprocating member, and extending and contracting means which is mounted on a frame uprightly provided on a base, and is operated to reciprocate the reciprocating member for expanding the pipes, wherein the extending and contracting means is constituted by at least one pair of cylinders disposed at both lateral side ends of the reciprocating member, respectively, for inserting the mandrels attached to the reciprocating member into the pipes to be expanded under pressure when contracted.

In the pipe expanding apparatus thus arranged, the cylinders as the extending and contracting means are disposed at both lateral side ends of the reciprocating member, respectively. Therefore, the reciprocating member can be smoothly moved ascended and descended via the cylinders each having small capacity and small size, without causing any distortion such as a twist.

BRIEF DESCRIPTION OF THE DRAWINGS

FIG. 5 shows a conventional pipe expanding apparatus in which; FIG. 5(*a*) is a front view of the apparatus and FIG. 5(*b*) is a partial perspective view.

DETAILED DESCRIPTION OF EMBODIMENTS

Hereinafter, several embodiments of the present invention will be described with reference to the drawings.

Figure 1:
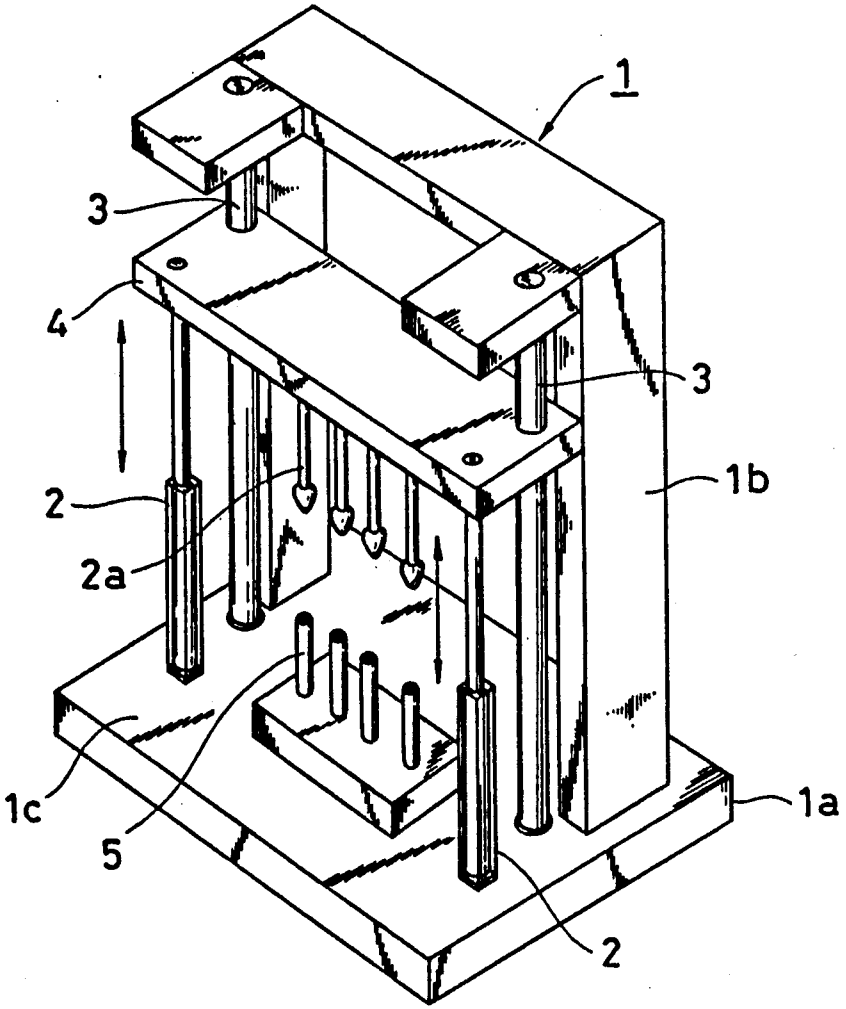
FIG. 1 is a perspective view showing the entirety of a pipe expanding apparatus according to one embodiment of the present invention.
Figure 4:
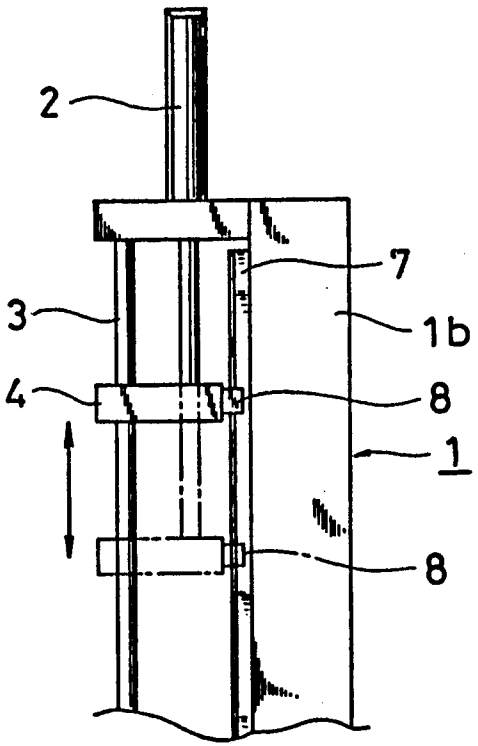
FIG. 4 is a side view showing still another embodiment of the present invention.

In FIG. 1, denoted by reference numeral 1 is a pipe expanding apparatus comprising a frame 1*b* uprightly provided on a base 1*a*.

Denoted by 2, 2 are a pair of cylinders mounted on the base 1*a* at desired locations and respectively attached to both lateral side ends of a reciprocating member 4 at desired locations for vertically moving the reciprocating member 4. The reciprocating member 4 is provided with a plurality of mandrels 2*a* extending vertically downwardly therefrom and positioned corresponding to pipes 5 to be expanded in one-to-one relation, which pipes are previously set on the base 1*a* at desired locations.

Denoted by 3, 3 are a pair of guide posts provided to penetrate through both the lateral side ends of the reciprocating member 4 for slidably guiding the reciprocating member 4 which is ascended and descended upon extension and contraction of the pair of cylinders 2, 2, respectively. The guide posts are each disposed behind either of the paired cylinders at desired locations.

The cylinders 2, 2, the guide posts 3, 3, the mandrels 2*a* and the pipes 5 to be expanded are all provided in vertical arrangements with respect to an upper surface 1*c* of the base 1*a*.

By using the pipe expanding apparatus according to this embodiment arranged as explained above, the pipes are expanded as follows.

First, when the cylinders 2, 2 are operated to descend the reciprocating member 4, the mandrels 2*a* extending vertically downwardly from the underside of the reciprocating member 4 are inserted under pressure into the pipes 5 previously set below the corresponding mandrels. The pipes 5 are thereby expanded in a desired manner.

During the above step, the cylinders 2, 2 also serve as another pair of guide posts for the reciprocating member 4, while evenly applying pressure to both the lateral side ends of the reciprocating member 4, when it is vertically moved. This permits the pipe expanding operation free from the occurrence of any distortion such as a twist.

Because the cylinders 2, 2 double as the guide posts in the pipe expanding apparatus 1, the entire height of the pipe expanding apparatus can be significantly reduced to such an extent as the height of the frame 1*b*. Therefore, the stroke of expanding the pipes can be freely set without being subjected to limitations due to the height of buildings.

Figure 2:
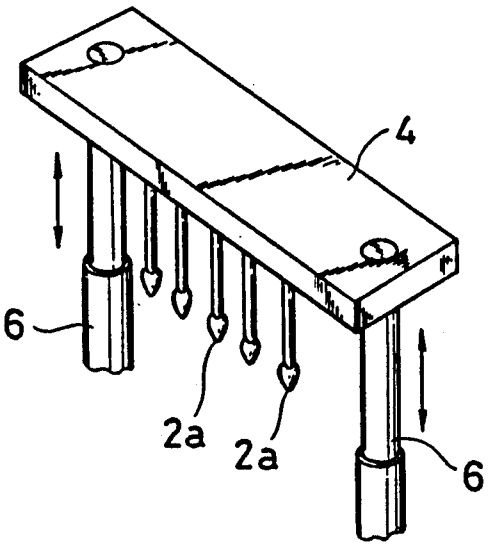
FIGS. 2 and 3 are perspective views showing other different embodiments of the present invention.
Figure 3:
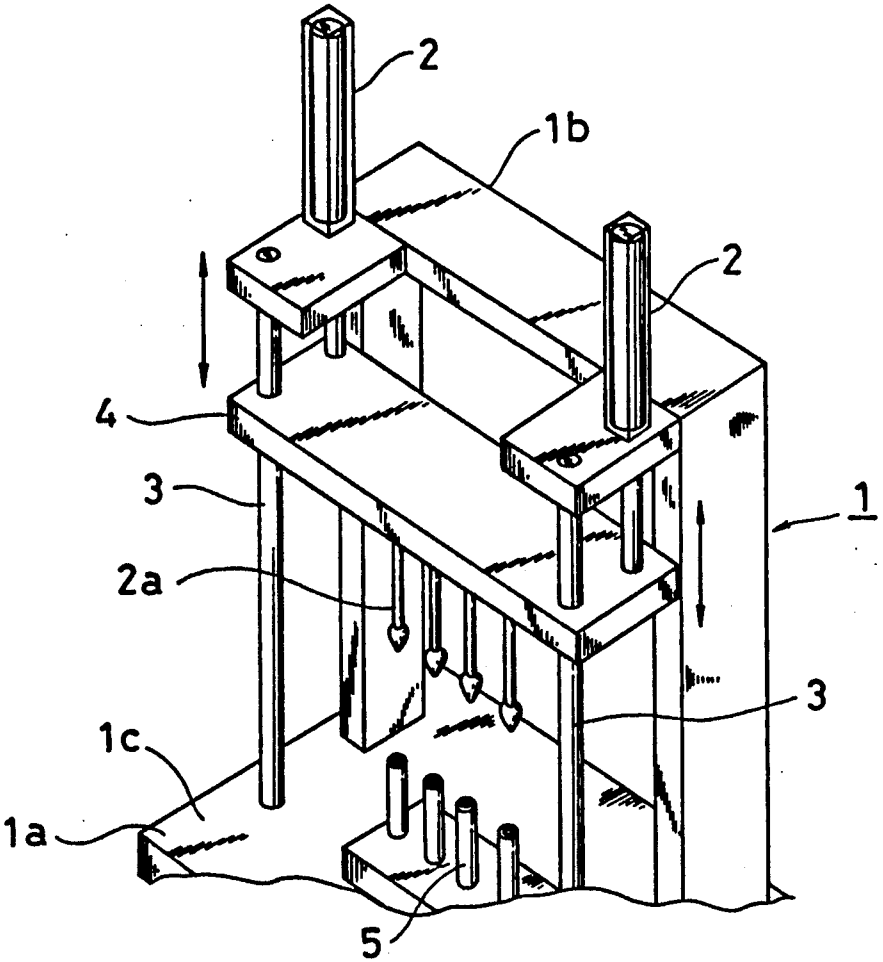
Figure 5B:
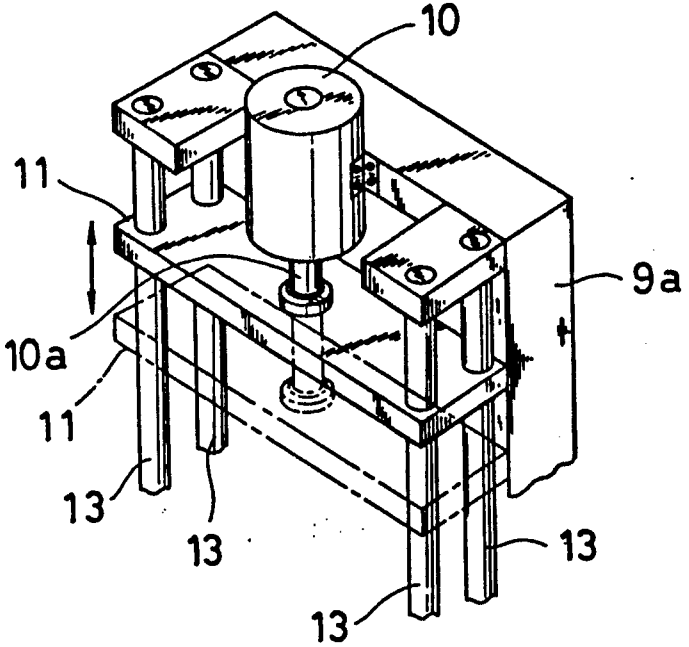
Figure 5A:
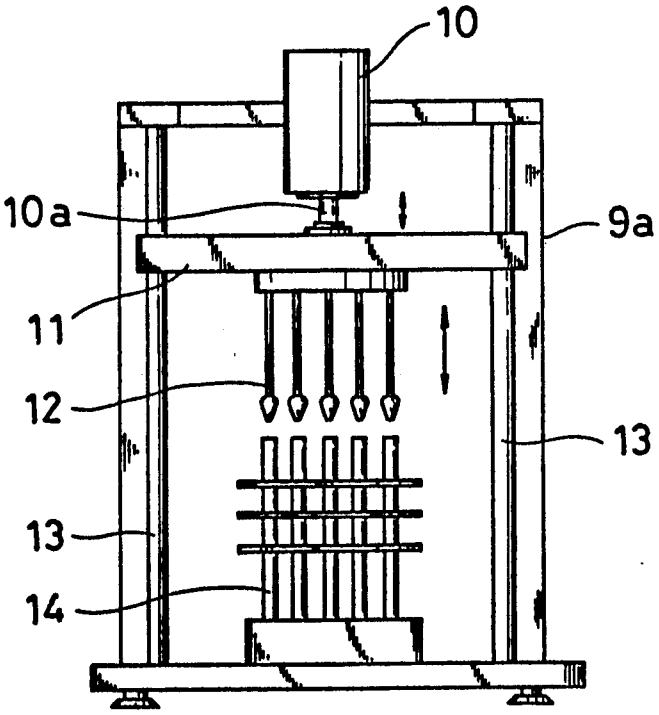

In the above embodiment, there are provided at least one pair of the cylinders 2, 2 respectively at both the lateral sides ends of the reciprocating member 4 on the front side, and at least one pair of the guide posts 3, 3 each located behind either of the cylinders 2, 2 for smooth vertical movement of the reciprocating member 4. However, the essence of the present invention resides in an arrangement that the reciprocating member 4 is vertically moved by the pair of cylinders 2, 2. In other words, the present invention is not limited to the foregoing embodiment in details of the arrangement. For example, as shown in FIG. 2, the apparatus may include not guide posts for their own specific use, but one pair of cylinders 6, 6 which only serve as guide posts. Alternatively, in the case of no limitations due to the height of buildings, the cylinders 2, 2 may be mounted above the lateral side ends of the reciprocating member 4 so as to extend and contract through the frame 1*b* at desired locations, as shown in FIG. 3.

Furthermore, the foregoing embodiment may be modified such that at least one pair of left and right track rails 7 are provided on the inner surfaces of the frame 1*b* at desired locations along which the reciprocating member 4 is ascended and descended, to extend in the direction of movement of the reciprocating member 4, whereas guides 8 are provided on the opposite end faces of the reciprocating member 4 to be slidably engaged with the corresponding rails 7, for the purpose of vertically moving the reciprocating member 4 in a smoother manner.

Thus, details in arrangement of the cylinders according to the present invention, such as shapes or forms and mounting locations, can be optionally changed for the designing purpose within a scope of the present invention.

As described above, according to the present invention, there is provided a pipe expanding apparatus comprising a reciprocating member to which a plurality of pipe expanding mandrels are attached to be capable of being inserted into a plurality of pipes to be expanded under pressure, a plurality of guide posts penetrating through the reciprocating member at desired locations for slidably guiding the reciprocating member, and extending and contracting means which is mounted on a frame uprightly provided on a base, and is operated to reciprocate the reciprocating member for expanding the pipes, wherein the extending and contracting means is constituted by at least one pair of cylinders disposed at both lateral side ends of the reciprocating member, respectively, for inserting the mandrels attached to the reciprocating member into the pipes to be expanded under pressure when contracted. As a result, the cylinders can also serve as the guide posts.

With such an arrangement, not only the extra guide posts can be dispensed with, but also the entire height of the pipe expanding apparatus can be significantly reduced by providing the cylinders between the reciprocating member and the base. This makes it very easy to carry and install the apparatus in buildings, and hence ensures the highly excellent operability.

Furthermore, since the pair of cylinders are disposed at both lateral side ends of the reciprocating member, respectively, pressure can be more uniformly applied to the reciprocating member at both the lateral side ends to vertically move it without causing any distortion such as a twist, for thereby achieving the pipe expanding operation in a desired manner. In addition, the cylinder can be reduced in both the capacity and the size per unit. It is thus possible to provide the pipe expanding apparatus which is manufactured at the lowered cost and the highly superior productivity.

I claim:

1. A pipe expanding apparatus comprising a frame uprightly provided on a base, a reciprocating member having opposite sides located on said frame, a plurality of pipe expanding mandrels attached to said reciprocating member between said opposite sides, said mandrels adapted to be inserted under pressure, into a plurality of pipes to be expanded, a plurality of guide posts penetrating through said reciprocating member at desired locations and attached to said frame for slidably guiding said reciprocating member, and extending and contracting means being mounted on said base for reciprocating said reciprocating member for expanding said pipes, wherein said extending and contracting means includes at least one pair of cylinders disposed at both sides of said reciprocating member, respectively, for inserting under pressure said mandrels attached to said reciprocating member into said pipes to be expanded when said at least one pair of cylinders is contracted.

2. A pipe expanding apparatus according to claim 1, wherein said pair of cylinders include at least one pair of said guide posts.

3. A pipe expanding apparatus according to claim 1, wherein at least one pair of track rails are provided at desired locations on said frame, and guide means which are provided at desired locations on said reciprocating member to be engaged with said track rails for slidably guiding said reciprocating member.

4. A pipe expanding apparatus according to claim 3, wherein at least one pair of track rails are provided at desired locations on said frame, and a guide means which are provided at desired locations on said reciprocating member to be engaged with said track rails for slidably guiding said reciprocating member.

* * * * *